United States Patent [19]

Kapke

[11] 4,121,351

[45] Oct. 24, 1978

[54] VENT APPARATUS FOR CLOTHES DRYER

[76] Inventor: Dwight L. Kapke, 2424 Washington, Lincoln, Nebr. 68502

[21] Appl. No.: 756,743

[22] Filed: Jan. 5, 1977

[51] Int. Cl.[2] ..... F26B 19/00

[52] U.S. Cl. ..... 34/86; 34/82; 34/239; 34/243 R

[58] Field of Search ..... 34/90, 91, 96–99, 34/133, 86, 233, 239, 242 R, 229, 235, 82; 248/65, 73; 239/587, 588; 98/40 R, 40 A, 40 N

[56] References Cited

U.S. PATENT DOCUMENTS

| | | | |
|---|---|---|---|
| 791,397 | 5/1905 | Asbury | 98/40 R |
| 2,100,186 | 11/1937 | Hagopian | 239/589 |
| 2,856,700 | 10/1958 | Wales | 34/91 |
| 3,064,360 | 11/1962 | Sholin | 34/91 |
| 3,999,304 | 12/1976 | Doty | 34/90 |
| 4,011,662 | 3/1977 | Davis et al. | 34/90 |

FOREIGN PATENT DOCUMENTS

| | | | |
|---|---|---|---|
| 1,102,164 | 10/1955 | France | 34/243 R |
| 421,405 | 3/1967 | Switzerland | 34/243 R |

*Primary Examiner*—Kenneth W. Sprague
*Assistant Examiner*—James C. Yeung

[57] ABSTRACT

Vent apparatus for a clothes dryer is disclosed comprising a tube having an outlet and an inlet opening. A removable screen is positioned across the outlet opening for filtering lint particles from the exhaust stream of a forced air clothes drying apparatus.

The tube is mounted on a tube positioning member which allows the tube to be adjustably rotated 360 degrees on an axis transverse to its longitudinal axis and 180° about its longitudinal axis. The outlet opening of the tube lies in a plane parallel to the longitudinal axis of the tube and is rotatable through an arc of 180° about the longitudinal axis.

5 Claims, 4 Drawing Figures

VENT APPARATUS FOR CLOTHES DRYER

SUMMARY OF THE INVENTION

The present invention relates to an indoor vent apparatus for a clothes dryer comprising a substantially rigid tube section having an outlet opening at one end and an inlet opening at the opposite end. The outlet opening lies in a plane substantially aprallel to the longitudinal axis of the tube. A replaceable filter screen element is removably secured over the outlet opening. The tube is mounted on tube positioning means for rotating the tube and the outlet opening 360° around an axis transverse to the longitudinal axis of the tube and 180° around the longitudinal axis of the tube.

The tube positioning member may further comprise a member form releasably securing the tube in any one of a plurality of positions 180° around the longitudinal axis of the tube.

The tube positioning member may comprise a plate lying in a plane rotatably mounted on an axle, the axle being secured to a planar base, the plane of the base being substantially parallel to the plane of the plate. The axle is substantially transverse to the plane of the plate and the base. A stop member is secured to the apparatus and positioned for stoppingly engaging the plate 360° around the axis with respect to the base.

The stop member may comprise teeth members positioned in an arc 360° around the axle in combination with teeth engaging members for releasably engaging the teeth when the plate is rotated about the axle.

The tube positioning member may also comprise a clamp member defining a clamp opening the longitudinal axis of the clamp opening being substantially coincident with the longitudinal axis of the tube. The inner diameter of the opening is substantially the same as the outer diameter of the tube, the opening being arranged to frictionally and slidably engage the outer surface of the tube.

The filter screen may comprise a screen for substantially removing all lint particles from the exhaust stream of a forced air clothes drying apparatus.

The filter screen may comprise a frame member defining a frame opening, the frame being frictionally engaged with the edges of the outlet opening of the tube. The frame opening is removably positionable over the outlet opening of the tube, a screen material being mounted across the frame opening.

DETAILED DESCRIPTION

Figure 1:
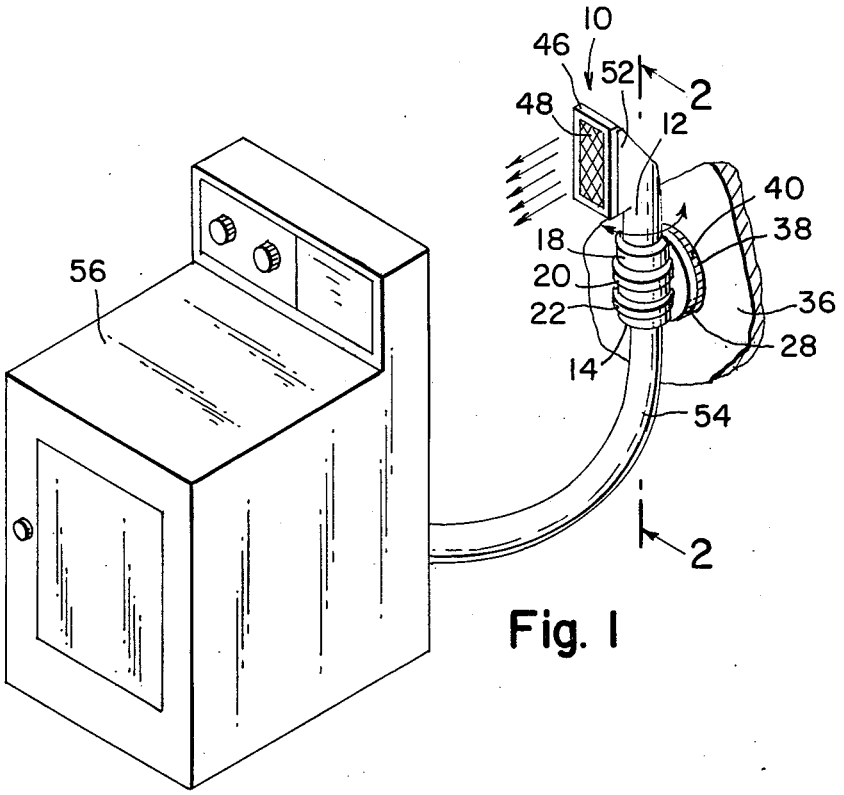
FIG. 1 comprises a perspective view illustrtaing clothes drying apparatus operatively secured by means of a flexible exhaust hose to vent apparatus for the clothes dryer, the vent apparatus comprising a substantially rigid tube having an outlet opening therein lying in a plane parallel to the longitudinal axis of the tube, the vent apparatus being mounted on a tube positioning member for rotating the tube 360° around an axis transverse to the longitudinal axis of the tube and 180° around the longitudinal axis of the tube so that the outlet opening of the tube may be rotated to 180° about the longitudinal axis of the tube according to one embodiment of the present invention.
Figure 2:
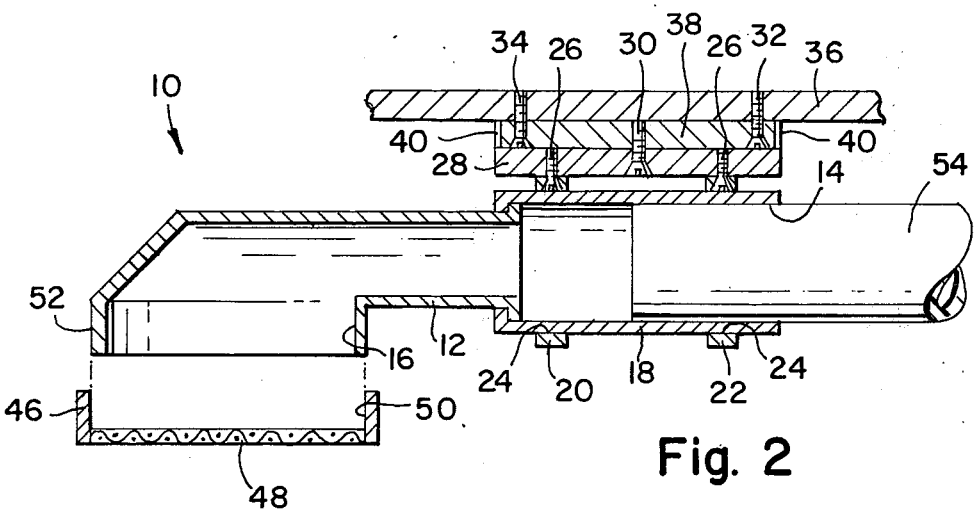
FIG. 2 comprises a cross-section view taken along the line 2—2 of FIG. 1.
Figure 3:
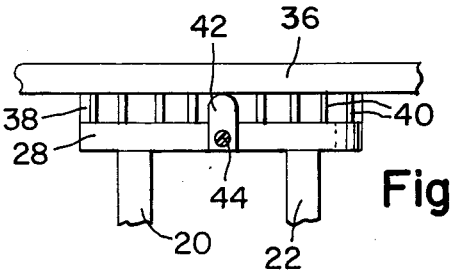
FIG. 3 comprises a partial plan view of a tube positioning member for the vent apparatus illustrated in FIG. 1 according to another embodiment of the present invention.
Figure 4:
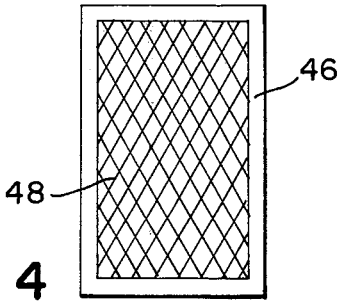
FIG. 4 comprises a front elevation of a filter screen adapted to fit over the outlet opening of the vent apparatus of FIG. 1 according to yet another embodiment of the present invention.

Vent apparatus for clothes dryers is disclosed in the prior art U.S. Pat. Nos. Hartung 3,716,925; Albertson 3,673,701; Tiganelli 3,487,624; McGoldrick 3,256,616; Alaback 2,983,050; Racheter 2,827,276; Morrison 2,799,948 and Moore 2,385,222.

Apparatus for the indoor venting of a clothes dryer is described in the Hartung reference noted previously whereby the vent gases from a clothes dryer are discharged into a room area in order to humidify the air in the room. One of the difficulties with the apparatus such as that described in the Hartung reference is that the vent is mounted completely around the circumference of a clothes dryer venting stack which precludes it from being wall mounted. If the Hartung venting device is positioned anywhere within about 6 inches to about 2 feet of a wall, the humidified gases that are vented from the dryer stack would be directed against the wall surface which would cause the wall to deteriorate significantly. Thus, the Hartung apparatus can only be employed on clothes drying devices that are vented indoors in which the clothes dryer is a substantial distance away from a wall. Ordinarily, appliances such as clothes dryers are not operated in the center of a room or any distance gretter than about 6 inches to one foot away from a wall area, consequently making the Hartung device impractical for most home installations.

Additionally, it would be advantageous to change the direction of the humidified vent gases emanating from a clothes dryer that is vented inside of a room so that no one part of the room would be constantly receiving a stream of clothes dryer vent gases.

It is therefore, an object of the present invention to overcome these and other difficulties encountered in the prior art.

It is a further object of the present invention to provide a novel indoor vent apparatus for a clothes dryer.

It is also an object of the present invention to provide an indoor vent apparatus for clothes dryers that may be mounted proximate to a wall area.

It is also an object of the present invention to provide an indoor vent apparatus for a clothes dryer in which the vent gases from a clothes dryer may be directed to any part of a room.

These and other objects have been achieved according to the present invention an will become apparent by reference to the disclosure and claims that follow as well as the appended drawing.

Referring to the drawings and FIGS. 1–4, therein indoor vent apparatus 10 for a clothes dryer 56 is illustrated comprising a tube 12 having an inlet opening 14 onto which a clothes dryer hose 54 is inserted, tube 12 having an outlet opening 16 of the plane of which is substantially parallel to the longitudinal axis of tube 12. Tube 12 is engaged by clamping brackets 20 and 22, the outer wall 18 of tube 12 in one section being substantially the same as the inner face 24 of brackets 20 and 22 so that a friction fit is formed between the outer wall 18 and the inner face 24 to allow tube 12 to rotate on its longitudinal axis within the brackets 20 and 22. The brackets 20 and 22 are secured to a plate 28 by means of screw fasteners 26, plate 28 in turn being pivotally mounted on screw 30 to a base plate 38 having a plurality of teeth 40 thereon which may be engaged by a pawl 42, one end of which is secured to plate 28 by means of a screw fastener 44. The base member 38 in turn is secured to a wall 36 by means of screw fasteners 32 and 34. The outlet end 16 of the tube 12 has a screen 48 positioned over the end, screen 48 being secured in a frame 46 the inner face 50 of frame 46 being substantially the same dimensions as the outer wall 52 at the opening 16 so that the frame 46 may be fit over the opening 16 by frictional engagement of the inner face 50 with the outer wall 52.

In use, the indoor vent apparatus 10 is mounted as is illustrated in FIG. 1 on a wall 36 so that the tube 12 may be rotated on its longitudinal axis through an arc of about 180 degrees allowing the opening 16 to be pivoted through an arc of 180° with respect to the wall surface 36. The tube 12 is also rotatable aobut the screw 30 through an arc of 360°. Thus, with the rotation of tube 12 about its longitudinal axis through an arc of 180° and the rotation of tube 12 about a pivot axis (screw 30) transverse to the longitudinal axis, the opening 16 may be positioned at any one of a plurality of positions so that hot and humid vent exhaust gases from the dryer 56 may be directed to any part of a room and further the gases will not be directed at the walls 36. It should be noted in the latter respect that the outer wall 52 of the tube 12 is sufficiently long so that the opening 16 will not be pivoted directly into the wall 36.

The screen 48 positioned inside of the frame 46 is selected to substantially remove all lint from the exhaust of the clothes dryer 56. A double screen may be inserted in frame 46 to further assure substantially complete removal of lint particles from the dryer 56.

Although the invention has been described with reference to some embodiments, it is not intended that the novel indoor vent apparatus for a clothes dryer be limited thereby but that modifications thereof are intended to be included as falling within the broad spirit and scope of the foregoing disclosure, the following claims and the appended drawings.

What is claimed is:

1. Vent apparatus for a clothes dryer comprising a substantially rigid tube section having an outlet opening at one end and an inlet opening at the opposite end thereof, said outlet opening lying in a plane parallel to the longitudinal axis of said tube, a replaceable filter screen outlet removably secured over said outlet opening, said tube being mounted on tube positioning means for rotating and releasably securing said tube and said outlet opening in a plurality of positions 360° around an axis transverse to the longitudinal axis of said tube and for rotating and releasably securing said tube in a plurality of positions 180° around the longitudinal axis of said tube, said tube positioning means comprising a plate lying in a plane, said plate being rotatably mounted on a planar base, the plane of said base being substantially parallel to the plane of said plate, stop means secured to said apparatus and positioned for Stoppingly engaging said plate with respect to said base, in an arc 360 degrees around said axis transverse to said longitudinal axis.

2. The apparatus of claim 1, wherein said stop means comprises teeth members positioned in an arc 360° around said axis in combination with teeth engaging means for releasably engaing said teeth when said plate is rotated about said axle.

3. The apparatus of claim 1, where said tube positioning means further comprises clamp means defining clamp opening therein, the longitudinal axis of said clamp opening being substantially coincident with the longitudinal axis of said tube, the inner diameter of said clamp being substantially the same as the outer diameter of said tube, said clamp opening being arranged to frictionally and slidably engage the outer surface of said tube.

4. The apparatus of claim 1, where said filter screen comprises a screen for substantially removing all lint particles from the exhaust stream of a forced air clothes drying apparatus.

5. The apparatus of claim 4, where said filter screen comprises a frame member defining a frame opening, said frame frictionally engaging the edges of said outlet opening of said tube, said frame opening being removably positionable over said outlet opening of said tube, a screen material being mounted across said frame opening.

* * * * *